US010276977B2

(12) United States Patent
Lesniak et al.

(10) Patent No.: US 10,276,977 B2
(45) Date of Patent: Apr. 30, 2019

(54) ELECTRICAL CONNECTOR WITH LEVER AND METHOD FOR OPERATING SAME

(71) Applicant: Delphi Technologies, LLC, Troy, MI (US)

(72) Inventors: Pawel Lesniak, Tarnow (PL); Lukasz Kot, Suloszowa (PL)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/944,057

(22) Filed: Apr. 3, 2018

(65) Prior Publication Data

US 2018/0309237 A1 Oct. 25, 2018

(30) Foreign Application Priority Data

Apr. 19, 2017 (EP) ..... 17167068

(51) Int. Cl.

| | |
|---|---|
| ***H01R 13/62*** | (2006.01) |
| ***H01R 13/629*** | (2006.01) |
| ***H01R 13/639*** | (2006.01) |
| ***H01R 13/506*** | (2006.01) |

(52) U.S. Cl.

CPC ..... *H01R 13/62977* (2013.01); *H01R 13/506* (2013.01); *H01R 13/6295* (2013.01); *H01R 13/62944* (2013.01); *H01R 13/639* (2013.01)

(58) Field of Classification Search

CPC ..... H01R 13/62977; H01R 13/62944; H01R 13/6295; H01R 13/506; H01R 13/639

USPC ..... 43/157

See application file for complete search history.

(56) References Cited

U.S. PATENT DOCUMENTS

| | | | | |
|---|---|---|---|---|
| 6,168,445 | B1 * | 1/2001 | Seutschniker ... | H01R 13/62977 439/157 |
| 6,213,795 | B1 * | 4/2001 | Drescher ..... | H01R 13/62977 439/152 |
| 6,305,957 | B1 * | 10/2001 | Fink ..... | H01R 13/62977 439/157 |

(Continued)

FOREIGN PATENT DOCUMENTS

| | | | |
|---|---|---|---|
| EP | 722203 | A1 | 7/1996 |
| EP | 2276122 | A1 | 1/2011 |
| JP | 2006331991 | A | 12/2006 |

*Primary Examiner* — Abdullah A Riyami
*Assistant Examiner* — Vladimir Imas
(74) *Attorney, Agent, or Firm* — Robert J. Myers

(57) ABSTRACT

An electrical connector includes a connector housing configured to receive a corresponding mating connector, a cable guide cover attached to the connector housing, and a mate assist system for assisting in mating to the corresponding mating connector. The mate assist system includes a lever moveable to assembly, open, and closed positions. The lever includes gear means connected with a slider in the connector housing. The lever moves the slider to a first, second, and third position. The lever is releasable and attachable to the connector housing only in the assembly position. The cable guide cover is attachable to the connector housing only when the lever is in the closed position. The slider has a releasing means cooperating with a releasing means of the corresponding mating connector to unblock the slider while mating and enabling movement of the lever to the closed position, thereby moving the slider to the third position.

15 Claims, 7 Drawing Sheets

(56) References Cited

U.S. PATENT DOCUMENTS

| | | | | |
|---|---|---|---|---|
| 6,666,697 | B2 * | 12/2003 | Yamashita | H01R 13/62977 439/152 |
| 7,189,086 | B2 * | 3/2007 | Fukatsu | H01R 13/62938 439/157 |
| 7,238,050 | B2 * | 7/2007 | Sakakura | H01R 9/032 439/157 |
| 7,303,415 | B2 * | 12/2007 | Tyler | H01R 13/4365 439/157 |
| 7,837,485 | B2 * | 11/2010 | Epe | H01R 13/506 439/157 |
| 7,922,504 | B2 * | 4/2011 | Sakamaki | H01R 13/4362 439/157 |
| 7,946,874 | B2 * | 5/2011 | Sakamaki | H01R 4/185 439/275 |
| 7,959,452 | B2 * | 6/2011 | Komiyama | H01R 13/62977 439/157 |
| 8,057,245 | B2 * | 11/2011 | Sakamaki | H01R 13/62933 439/157 |
| 8,246,365 | B2 * | 8/2012 | Shishikura | H01R 13/62955 439/157 |
| 8,439,695 | B2 * | 5/2013 | Komiyama | H01R 13/62944 439/157 |
| 9,048,579 | B2 * | 6/2015 | Itou | H01R 13/62944 |
| 9,865,961 | B2 * | 1/2018 | Shibaya | H01R 13/516 |
| 10,014,628 | B2 * | 7/2018 | Mito | H01R 13/26 |
| 10,109,952 | B2 * | 10/2018 | Campbell | H01R 13/62944 |
| 2009/0263998 | A1 | 10/2009 | Epe et al. | |

* cited by examiner

ELECTRICAL CONNECTOR WITH LEVER AND METHOD FOR OPERATING SAME

CROSS-REFERENCE TO RELATED APPLICATION

This application claims the benefit under 35 U.S.C. § 119(a) of Patent Application No. 17167068.02 filed in the European Patent Office on Apr. 19, 2017, the entire disclosure of which is hereby incorporated by reference.

TECHNICAL FIELD OF THE INVENTION

This invention generally relates to a connector assembly, and in particular to an electrical connector assembly including an automotive electrical plug connector connectable to a complementary electrical connector to form an electrical connecting assembly with a large number of pin contacts, of the type used, for example, to connect a vehicle wiring system to an electrical distribution center.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
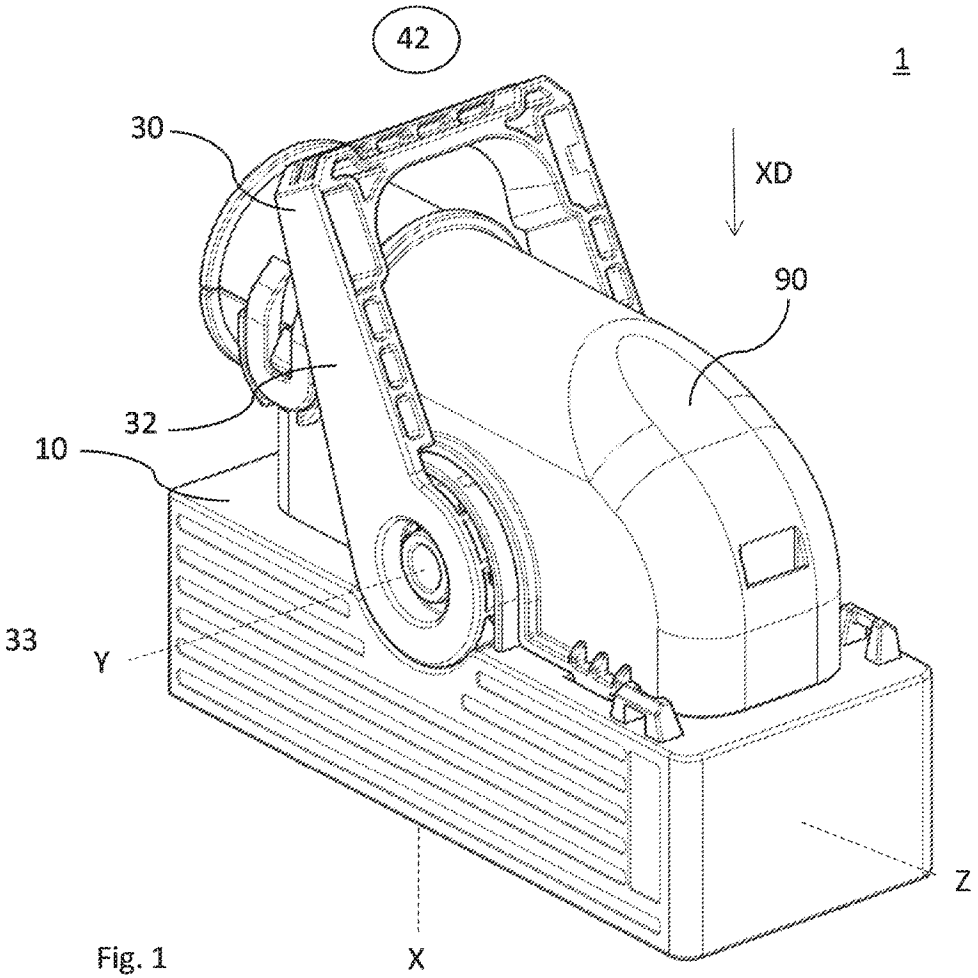
FIG. 1 is a perspective view of an electrical connector assembly according to one embodiment.

An electrical connector includes a connector housing configured to receive a corresponding mating connector, a cable guide cover attachable to the connector housing, and a mate assist system configured to assist in mating to the corresponding mating connector. The mate assist system includes a lever that is pivotably arranged on the connector housing. The lever is pivotable from a lever assembly position to a lever open position and from the lever open position to a lever closed position. The lever comprises gear means engaged with a slider. The slider is slideably provided in the connector housing. The slider comprises complementary gear means for engaging with the lever. Correspondingly, the lever slides from a slider first position to a slider second position and from the slider second position to a slider third position. The lever is releasable and attachable to the connector housing only in the assembly position. The cable guide cover is attachable to the connector housing only when the lever is in the closed position. The slider is blocked in the slider second position by blocking means of the cable guide cover, cooperating with a blocking means of the slider. The slider comprises releasing means for cooperating with releasing means of the corresponding mating connector, to unblock the slider while mating, enabling movement of the lever to the closed position, thereby moving the slider to the slider third position.

The an electrical connector enables free movement of the lever while assembling the terminals with attached wires. After all necessary terminals are equipped a cover is assembled to the connector housing that locks the lever in a predefined, safe shipping position. Finally arrived in the assembly plant where the mating to the corresponding mating connector is conducted, the lever is unlocked by the corresponding mating connector. Because it is not possible to move the lever of the connector before mating the electrical connector to the corresponding mating connector, there is a feedback for the operator that indicates that the connector is mated properly. The slider and the flexible arm comprise sloped areas that cooperate with each other to allow movement of the slider after assembling the cable guide cover. Due to this the lever is moveable from the closed position to the open position.

A method for assembling an electrical connector, in particular an electrical connector is presented herein. The method comprises the steps of;

- providing a connector housing, a cable guide cover, a lever and the slider;
- positioning the slider in the connector housing in a slider first position;
- aligning the lever according to a lever assembly position;
- mounting the lever to the connector housing;
- mounting the cable guide cover; and
- move the lever to a lever open position.

A method for assembling an electrically wire harness comprising, electrical wires with terminals on the ends, a corresponding mating connector and an electrical connector is also presented herein. The method comprises the steps of;

- providing electrical wires with terminals on the ends, the corresponding mating connector, a connector housing; a cable guide cover, a lever and a slider;
- positioning the slider in the connector housing in a slider first position;
- aligning the lever according from a lever assembly position;
- mounting the lever to the connector housing;
- moving the lever to a lever closed position;
- inserting the terminals to the respective cavities in the connector housing;
- mounting the cable guide cover to the connector housing;
- moving the lever to a lever open position; and
- mating the connector to the corresponding mating connector moving the lever to a lever closed position.

The connector may define a mating axis, a mating direction along the mating axis, a sliding axis perpendicular to the mating axis, and a pivoting axis perpendicular to the mating axis and the sliding axis. The lever pivots around the pivoting axis and moves the slider back and forth along the sliding axis. When the electrical connector is mating with the corresponding counter connector the connectors are moved along a mating axis, towards each other.

The gear means may include a rack and pinion system, whereby a gear wheel is formed on a free end of a lever arm of the lever and wherein a plurality of teeth is formed on the slider. The rack and pinion system translates the rotation movement of the lever into a translation movement. This design provides a robust gear system.

A hole may be formed on a free end of a lever arm of the lever, cooperating with a shaft, protruding along the pivoting axis from the connector housing, and pivotably holding the lever. The hole comprises a coding slot extending perpendicular to the pivoting axis. The shaft comprises a rib portion extending perpendicular to the pivoting axis from the shaft. The lever arm is movable along the pivoting axis, when the coding slot and the rib portion are aligned along the pivoting axis. This design provides protection, for the lever, from accidentally slipping from the shaft while being operated. While operation the lever is guided between the connector housing and the coding rib.

The coding slot and the rib portion may be aligned along the pivoting axis, when the lever is in the lever assembly position. The coding slot and the coding rib are only aligned in this position. Only in this position the shaft can be moved into the hole of the lever. Thereby it is moved until it is stopped by the connector housing. To assemble or disassemble the lever, the cover has to be removed.

The cable guide cover may include a cover protrusion protruding outwards, along the pivoting axis from the cable guide cover. The cable guide cover protrusion is positioned accordingly to cooperate with the lever to prevent movement from the lever open position to the lever assembly position. To prevent the movement of the lever to the assembly position while the cable guide cover is mounted, the cable guide cover comprises protrusions protruding from the outer surface of the cover. The protrusions can have the shape of ribs limiting the range of the pivoting lever to positions between the open position and the closed position.

The cover protrusion may prevent the lever from accidental dismounting from the electrical connector. The cover protrusion blocks the lever movement to its assembly position. So it is not possible to dismount the lever from connector before dismounting the cover. The cover protrusion prevents mounting the lever when the cable guide cover is attached to the connector housing. This prevents issues while service e.g. in a garage. The protrusion protrudes close to the shaft from the cable guide cover and blocks the movement opportunity of the lever arm along the pivoting axis, moving towards the connector housing. This makes it impossible to assemble the lever while the cable guide cover is mounted. This prevents misassembling of the electrical connector.

The blocking means may include a tongue protruding from the cable guide cover into a recess in the slider, thereby blocking the slider. This design is a simple but effective locking system for the slider.

The cable guide cover may have a tongue and whereby the releasing means of the slider comprise a flexible arm formed on the slider, whereby an end portion of the flexible arm is arranged adjacent to the tongue and aligned along the sliding axis with the tongue. The flexible arm comprises a release protrusion, protruding inwards the connector housing into a receiving portion, configured to receive a portion of the corresponding mating connector. The releasing means of the corresponding mating connector, push the release protrusion out of the receiving portion while mating, thereby flexing the flexible arm outwards and moving the end portion out of alignment to the tongue. The flexible arm is guided around the tongue of the cable guide cover while mating. The arm can have a rectangular cross section with a bigger extension along the sliding axis to improve the robustness against forces acting along the sliding axis and a smaller extension perpendicular to the sliding axis to improve flexibility perpendicular to the sliding axis.

The slider and the flexible arm may be formed integrally in one part. The flexible arm is a part of the slider and can be manufactured in one turn with the slider. That design safes costs and makes additional parts unnecessary.

The tongue may extend along the mating axis in a mating direction and the flexible arm extends along the mating axis opposite to the mating direction. The cable guiding cover can be assembled also in limited building spaces. The probability of damaging or breaking the tongue is limited because the tongue does not protrude to outside of the cross-section of the cable guiding cover.

The electrical connector assembly may include an electrical connector and may further encompass the corresponding mating connector.

The electrical connector assembly may also include an electric wire, wherein an end of the electric wire is connected to at least one electrical contact connected to the connector housing.

The electrical connector assembly may further include cam means configured to move a terminal positioning assurance member (TPA). The terminal positioning assurance member is movably connected to the connector housing. The TPA member comprising complementary cam means for engaging with the cam means of the slider configured to move the TPA member correspondingly from a TPA first position to a TPA second position and from the TPA second position to a TPA third position FIG. 1 shows as non-limiting example of an electrical connector 1 including a connector housing 10 configured to receive a corresponding mating connector 100, a cable guide cover 90 attachable to the connector housing 10 and a mate assist system configured to assist in mating to the corresponding mating connector 100. The mate assist system comprises a lever 30 pivotably arranged on the connector housing 10, wherein the lever 30 is pivotable from a lever assembly position 40 to a lever open position 42 and from the lever open position 42 to a lever closed position 44 (best shown in FIG. 5). The electrical connector 1 comprises a mating axis X and a mating direction XD along the mating axis, a sliding axis Z perpendicular to the mating axis X and a pivoting axis Y perpendicular to the mating axis X and the sliding axis Z.

Figure 2:
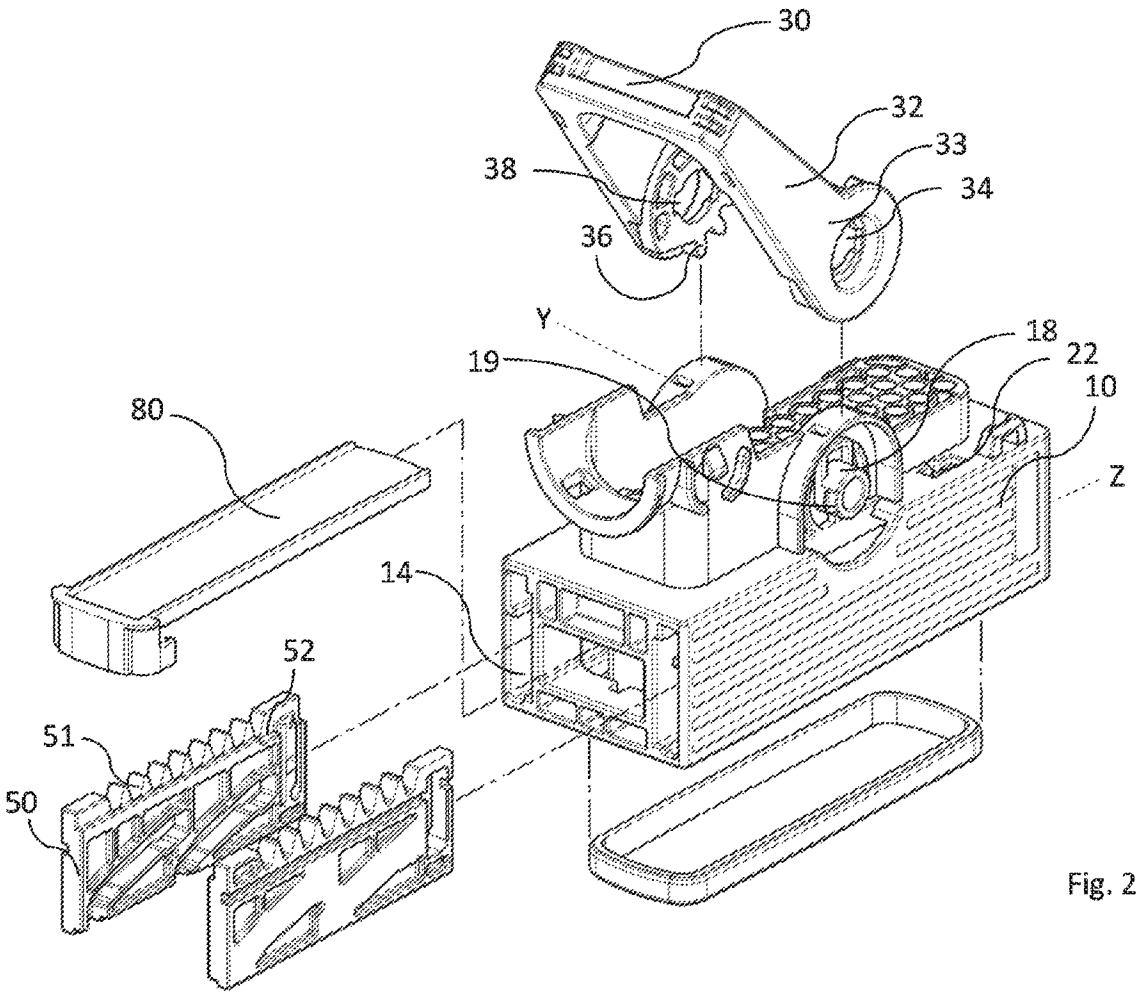
FIG. 2 is an exploded view of the electrical connector of FIG. 1 showing a connector housing, a lever, a terminal position assurance (TPA) device and a slider according to one embodiment.

FIG. 2 shows the connector housing 10 the lever 30 and the slider 50 in an exploded view. The lever 30 comprises gear means engaging with a slider 50. The slider 50 is slideably provided in a slider receiving portion 14 inside the connector housing 10. The slider 50 comprises complementary gear means for engaging with the lever 30, for correspondingly sliding the lever 30 from a slider first position 60 to a slider second position 62 and from the slider second position 62 to a slider third position 64. The lever 30 is releasable and attachable to the connector housing 10 only in the lever assembly position 40. The gear means comprises a rack and pinion system whereby a gear wheel 36 is formed on a free end 33 of a lever arm 32 of the lever 30 and wherein a plurality of teeth 51 is formed on the slider 50. A hole 34 is formed on a free end 33 of a lever arm 32 of the lever 30, cooperating with a shaft 18, protruding along the pivoting axis Y from the connector housing 10, holding the lever pivotably. The hole 34 comprises a coding slot 38 extending perpendicular to the pivoting axis Y, wherein the shaft comprises a rib portion 19 extending perpendicular to the pivoting axis Y from the shaft 18. The lever arm 32 is movable along the pivoting axis Y, when the coding slot 38 and the rib portion 19 are aligned along the pivoting axis Y. The connector comprises also a terminal positioning assurance member (TPA) 80. The terminal positioning assurance member 80 is movably connected to the connector housing 10.

Figure 3A:
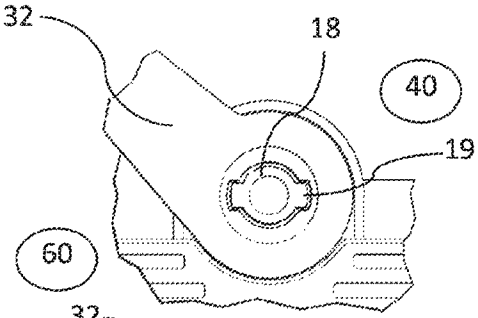
FIGS. 3*a*, 3*b* and 3*c* is a detailed view of a lever hole and a shaft in a lever assembly position, a lever open position and a lever closed position respectively according to one embodiment.
Figure 3B:
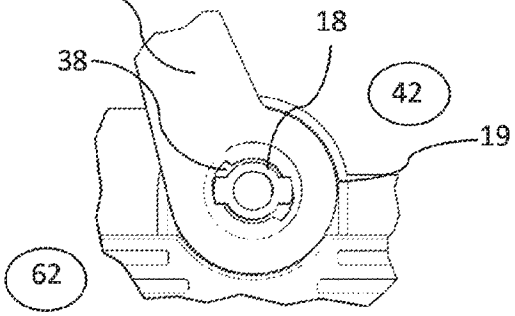
Figure 3C:
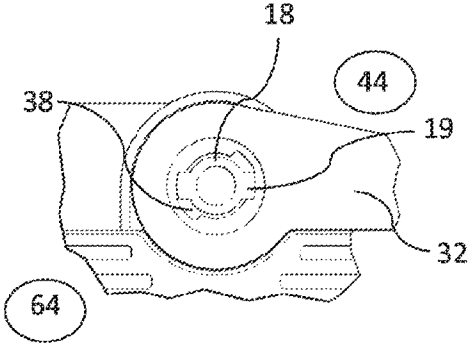

FIGS. 3*a*, 3*b* and 3*c* show detailed views on the hole 34 and the shaft 18 in the lever assembly position 40, the lever open position 42 and the lever closed position 44. In the lever assembly position 40 the rib portion 19 and the coding slot 38 are aligned. In the lever assembly position 40, the slider 50 is in the slider first position 60, in the lever open position 42 the slider 50 is in the slider second position 62 and in the lever closed position 44 the slider 50 is in the slider third position 64.

Figure 4:
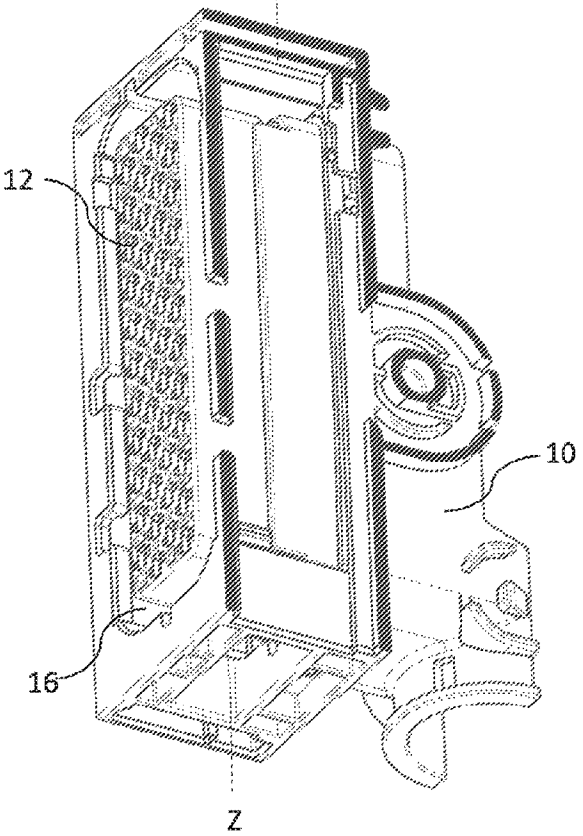
FIG. 4 is a perspective view of the mating face of the connector housing according to one embodiment.

FIG. 4 shows a perspective view of the mating face of the connector housing 10. The connector receiving portion 16 surrounds the cavities 12. In the lever open position 42 and in the lever closed position 44 the lever 30 cannot be attached to or removed from the connector housing 10.

Figure 5B:
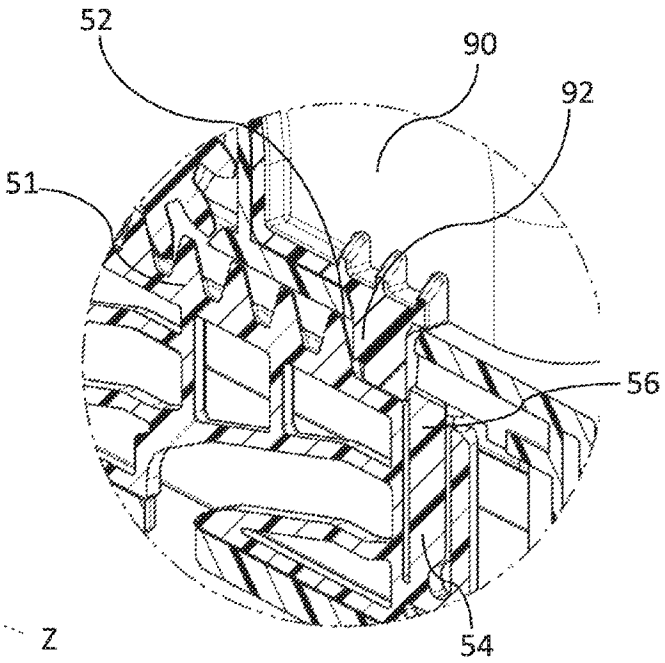
FIGS. 5*a* and 5*b* are cross section views of the electrical connector of FIG. 1 according to one embodiment.
Figure 5A:
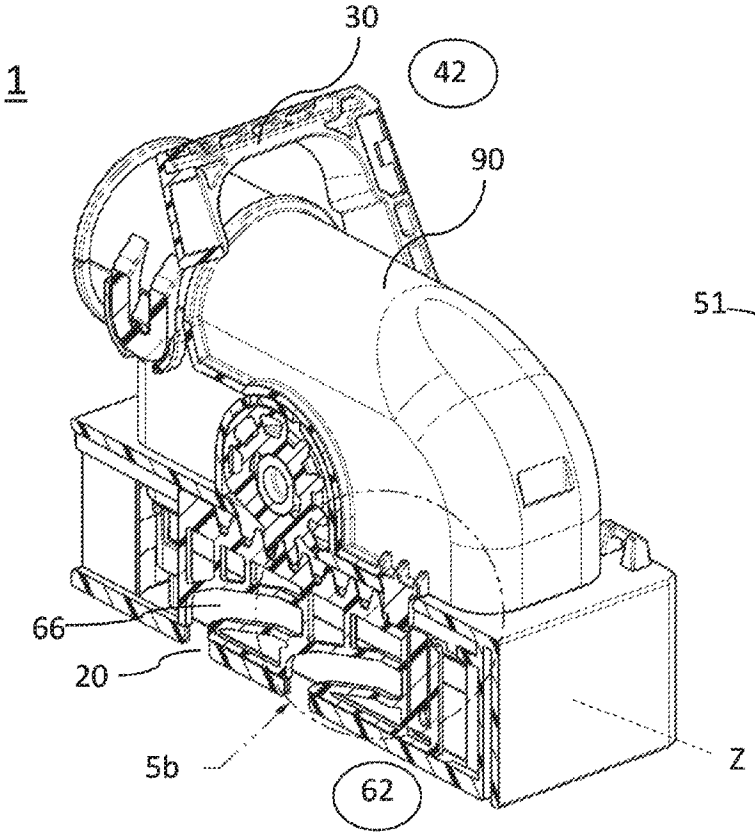

FIGS. 5*a* and 5*b* show the electrical connector 1 in a cut view. FIG. 5*b* shows details in enlarged form. The cut is carried out along the sliding axis Z to remove the outer wall of the connector housing 10 to better show the rack and pinion system. The gear wheel 36 interacts with the teeth 51 of the slider 50 for correspondingly sliding the lever 30 from a slider first position 60 (not shown) to a slider second position 62 and from the slider second position 62 to a slider third position 64 (not shown). An opening 20 in the connector housing 10 and a cam groove 66 are provided to guide pegs (not shown) attached on the outside of the corresponding mating connector 100 while mating. The skilled person understands how the positions cooperate with each other. The cable guide cover 90 is attachable to the connector housing 10 only when the lever 30 is in the lever closed position 44. The slider 50 is blocked in the slider second position 62 by blocking means of the cable guide cover 90 cooperating with a blocking means of the slider 50. The blocking means comprises a tongue 92 protruding from the cable guide cover 90 through a lock opening 22 into a recess 52 in the slider 50, thereby blocking the slider 50. The releasing means of the slider comprise a flexible arm 54 formed on the slider 50. An end portion 56 of the flexible arm is arranged adjacent to the tongue 92 and aligned along the sliding axis Z with the tongue 92.

Figure 6B:
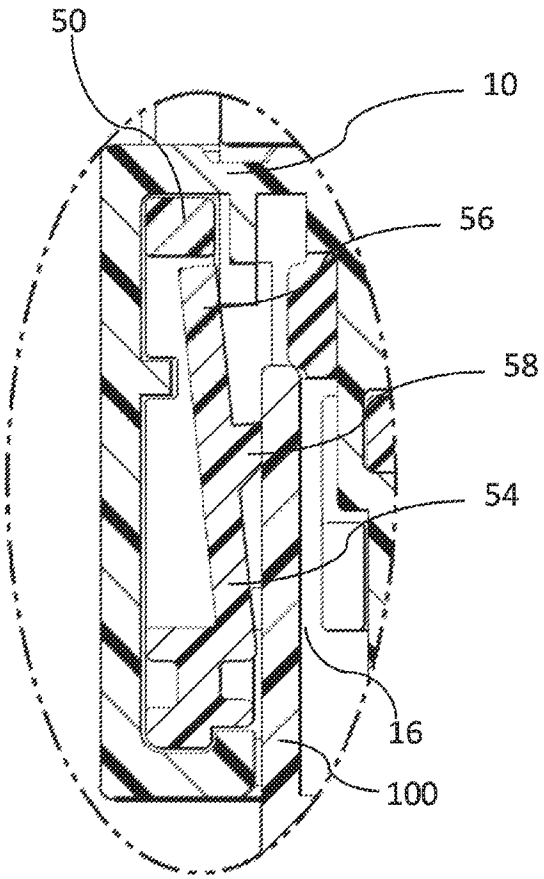
FIGS. 6*a* and 6*b* are cross section views of the electrical connector of FIG. 1 mated with a corresponding mating connector according to one embodiment.
Figure 6A:
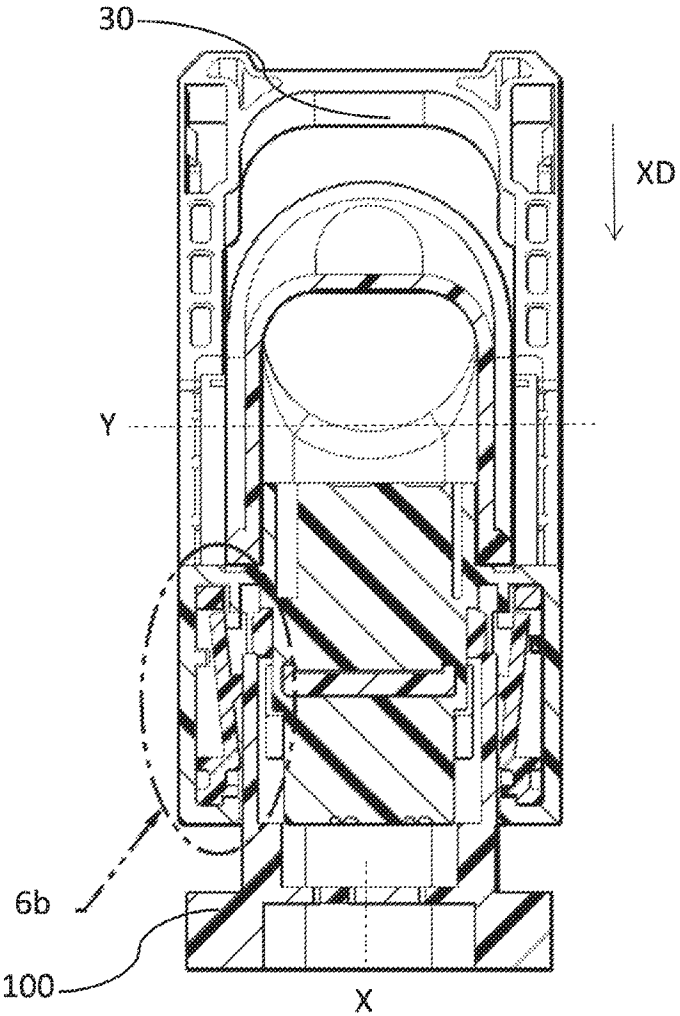

FIGS. 6*a* and 6*b* show the electrical connector 1 and the mating connector 100 in a cut view. FIG. 6*b* shows details in enlarged form. The cut is carried out along the mating axis X. The slider 50 comprises releasing means for cooperating with releasing means of the corresponding mating connector 100, to unblock the slider 50 while mating, thereby enabling movement of the lever 30 to the lever closed position 44, thereby moving the slider 50 to the slider third position 64. The flexible arm 54 comprises a release protrusion 58 protruding inwards of the connector housing 10 into the connector receiving portion 16. The connector receiving portion 16 is configured to receive a portion of the corresponding mating connector 100. Releasing means of the corresponding mating connector 100 push the release protrusion 58 out of the connector receiving portion 16 while mating, thereby flexing the flexible arm 54 outwards and move the end portion 56 out of alignment to the tongue 92.

Figure 7:
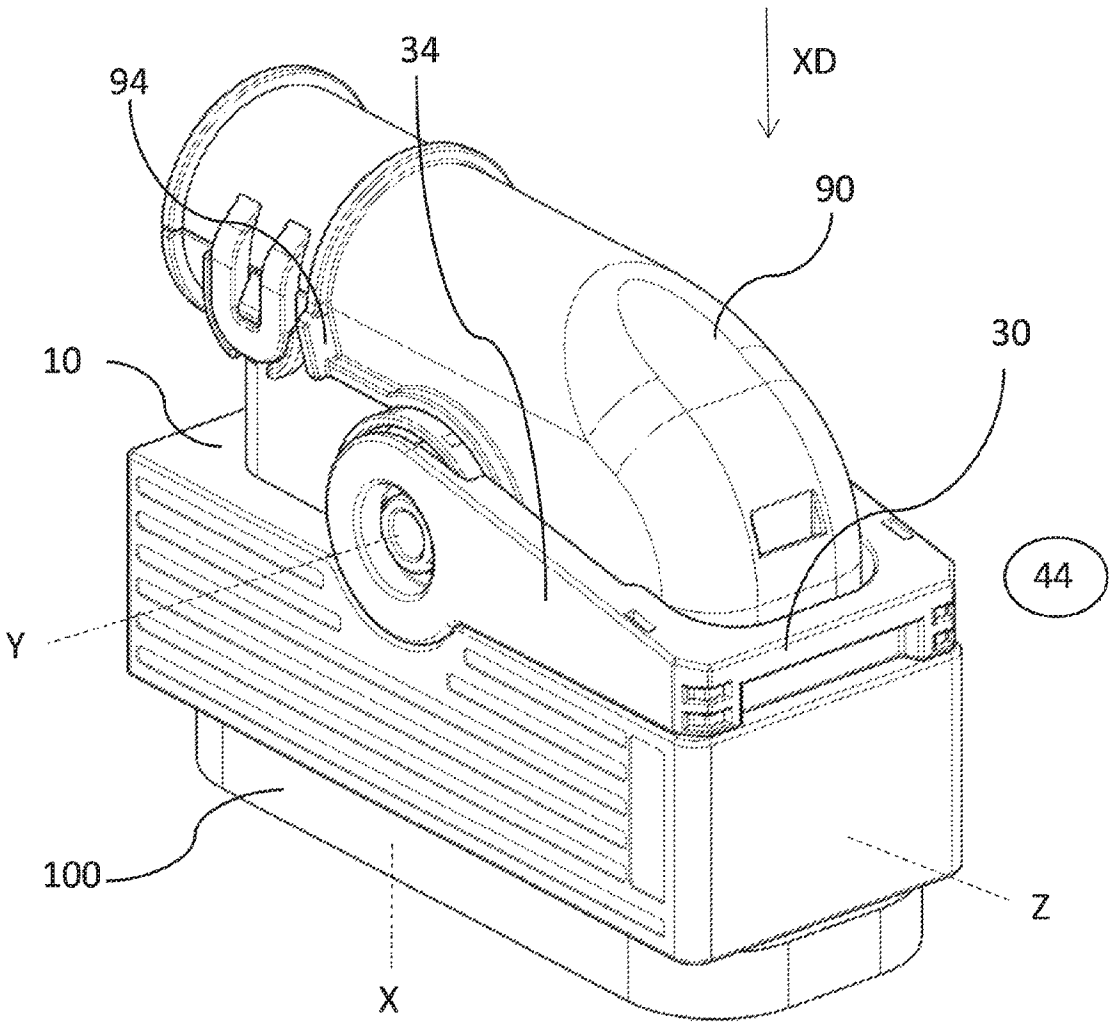
FIG. 7 illustrates the electrical connector connected with the corresponding mating connector with the lever enclosed position according to one embodiment.

FIG. 7 shows the electrical connector 1 connected to the corresponding mating connector 100 with the lever 30 in the lever closed position 44. The cover protrusion 94 prevents to move the lever 30 from the lever open position 42 to the lever assembly position 40 and also from mounting the lever 30 when the cable guide cover 90 is attached to the connector housing 10. The cover protrusion 94 protruding outwards, along the pivoting axis Y from the cable guide cover 90 and acts as an end stop for the lever 30. The cover protrusion 94 is positioned accordingly to cooperate with the lever 30 to prevent movement from the lever open position 42 to the lever assembly position 40.

Figure 8:
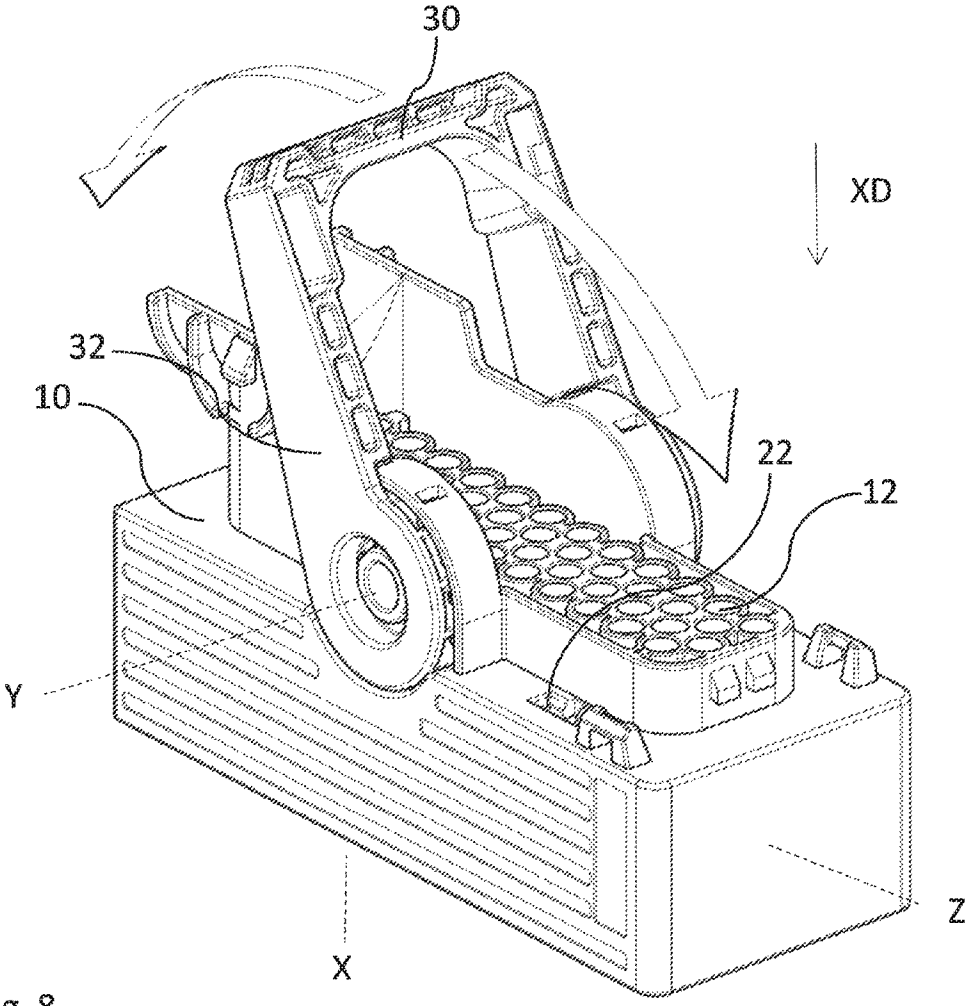
FIG. 8 shows the connector housing with the attached lever according to one embodiment.

FIG. 8 shows the connector housing 10 with attached lever 30. The cavities 12 are only in this position fully accessible to be equipped with terminals. The lever 30 is freely movable around the pivoting axis Y.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Additionally, directional terms such as upper, lower, etc. do not denote any particular orientation, but rather the terms upper, lower, etc. are used to distinguish one element from another and establish a relationship between the various elements.

We claim:

1. An electrical connector, comprising;

a connector housing configured to receive a corresponding mating connector;

a cable guide cover attachable to the connector housing; and a mate assist system configured to assist mating to the corresponding mating connector, wherein the mate assist system comprises a lever pivotably arranged on the connector housing, wherein the lever is pivotable from a lever assembly position, to a lever open position, and to a lever closed position, wherein the lever comprises gear means engaging with a slider, wherein the slider is slideably disposed in the connector housing, wherein the slider comprises complementary gear means for engaging with the lever for correspondingly sliding the lever from a slider first position to a slider second position and from the slider second position to a slider third position, wherein the lever is releasable and attachable to the connector housing only in an assembly position and wherein the cable guide cover is attachable to the connector housing only when the lever is in the lever closed position, wherein the slider is blocked in the slider second position by a cable guide cover blocking means, cooperating with a slider blocking means, and wherein the slider comprises a slider releasing means configured to cooperate with a corresponding mating connector releasing means to unblock the slider while mating, thereby enabling movement of the lever to the lever closed position and moving the slider to the slider third position.

2. The electrical connector according to claim 1, wherein the electrical connector defines a mating axis, a mating direction along the mating axis, a sliding axis perpendicular to the mating axis, and a pivoting axis perpendicular to the mating axis and the sliding axis.

3. The electrical connector according to claim 2, wherein the gear means comprises a rack and pinion system, wherein a gear wheel is formed on a free end of a lever arm of the lever, and wherein a plurality of teeth is formed on the slider.

4. The electrical connector according to claim 3, wherein a hole is formed on the free end of the lever arm, cooperating with a shaft, protruding along the pivoting axis from the connector housing, holding the lever pivotably, wherein the hole comprises a coding slot extending perpendicular to the pivoting axis, wherein the shaft comprises a rib portion extending perpendicular to the pivoting axis from the shaft and whereby the lever arm is movable along the pivoting axis, when the coding slot and the rib portion are aligned along the pivoting axis.

5. The electrical connector according to claim 4, wherein the coding slot and the rib portion are aligned along the pivoting axis, when the lever is in the lever assembly position.

6. The electrical connector according to claim 5, wherein the cable guide cover comprises a cover protrusion protruding outwards, along the pivoting axis from the cable guide cover, whereby the cover protrusion is positioned accordingly to cooperate with the lever to prevent movement from the lever open position to the lever assembly position.

7. The electrical connector according to claim 6, wherein the cover protrusion prevents mounting the lever when the cable guide cover is attached to the connector housing.

8. The electrical connector according to claim 2, wherein the cable guide cover blocking means comprises a tongue protruding from the cable guide cover into a recess (52) in the slider, thereby blocking the slider.

9. The electrical connector according to claim 8, wherein the cable guide cover comprises a tongue and whereby the slider releasing means comprises a flexible arm formed on the slider, whereby an end portion of the flexible arm is arranged adjacent to the tongue and aligned along the sliding axis with the tongue, the flexible arm comprises a release protrusion protruding inwards of the connector housing into a receiving portion, configured to receive a portion of the corresponding mating connector, whereby the corresponding mating connector releasing means pushes the release protrusion out of the receiving portion while mating, thereby flexing the flexible arm outwards and moving the end portion out of alignment to the tongue.

10. The electrical connector according to claim 9, wherein the slider and the flexible arm are made integrally formed in one part.

11. The electrical connector according to claim 10, wherein the tongue extends along the mating axis in the mating direction and the flexible arm extends along the mating axis opposite to the mating direction.

12. An electrical connector assembly, comprising the electrical connector according to claim 1 and further comprising the corresponding mating connector.

13. The electrical connector assembly, according to the claim 12, further comprising an electric wire, wherein an end of the electric wire is connected to at least one electrical contact connected to the connector housing.

14. A method for assembling an electrical connector, comprising the steps of:

providing a connector housing configured to receive a corresponding mating connector, a cable guide cover attachable to the connector housing, and a mate assist system configured to assist mating to the corresponding mating connector, wherein the mate assist system comprises a lever pivotably arranged on the connector housing, wherein the lever is pivotable from a lever assembly position, to a lever open position, and to a lever closed position, wherein the lever comprises gear means engaging with a slider, wherein the slider is slideably disposed in the connector housing, wherein the slider comprises complementary gear means for engaging with the lever for correspondingly sliding the lever from a slider first position to a slider second position and from the slider second position to a slider third position, wherein the lever is releasable and attachable to the connector housing only in an assembly position and wherein the cable guide cover is attachable to the connector housing only when the lever is in the lever closed position, wherein the slider is blocked in the slider second position by a cable guide cover blocking means, cooperating with a slider blocking means, and wherein the slider comprises a slider releasing means configured to cooperate with a corresponding mating connector releasing means to unblock the slider while mating, thereby enabling movement of the lever to the lever closed position and moving the slider to the slider third position;

positioning the slider in the connector housing in the slider first position;

aligning the lever according to the lever assembly position;

mounting the lever to the connector housing;

moving the lever to the lever closed position; and mounting the cable guide cover.

15. Method for assembling an electrical wire harness, comprising the steps of:

providing electrical wires terminated by electrical terminals, an electrical connector, and a corresponding mating connector, wherein the electrical connector includes a connector housing configured to receive the corresponding mating connector, a cable guide cover attachable to the connector housing, and a mate assist system configured to assist mating to the corresponding mating connector, wherein the mate assist system comprises a lever pivotably arranged on the connector housing, wherein the lever is pivotable from a lever assembly position, to a lever open position, and to a lever closed position, wherein the lever comprises gear means engaging with a slider, wherein the slider is slideably disposed in the connector housing, wherein the slider comprises complementary gear means for engaging with the lever for correspondingly sliding the lever from a slider first position to a slider second position and from the slider second position to a slider third position, wherein the lever is releasable and attachable to the connector housing only in an assembly position and wherein the cable guide cover is attachable to the connector housing only when the lever is in the lever closed position, wherein the slider is blocked in the slider second position by a cable guide cover blocking means, cooperating with a slider blocking means, and wherein the slider comprises a slider releasing means configured to cooperate with a corresponding mating connector releasing means to unblock the slider while mating, thereby enabling movement of the lever to the lever closed position and moving the slider to the slider third position;

positioning the slider in the connector housing in the slider first position;

aligning the lever according from the lever assembly position;

mounting the lever to the connector housing;

moving the lever to the lever closed position;

inserting the electrical terminals to the respective cavities in the connector housing;

mounting the cable guide cover to the connector housing;

moving the lever to the lever open position;

mating the electrical connector to the corresponding mating connector; and moving the lever to the lever closed position.

* * * * *